US008876678B2

(12) United States Patent
Flentye et al.

(10) Patent No.: US 8,876,678 B2
(45) Date of Patent: Nov. 4, 2014

(54) EXERCISE DEVICE AND HANDLE FOR SAME

(75) Inventors: Herbert T. Flentye, Glenview, IL (US); Gregory Niederlander, Gurnee, IL (US)

(73) Assignee: SPRI Products, Inc., Libertyville, IL (US)

( * ) Notice: Subject to any disclaimer, the term of this patent is extended or adjusted under 35 U.S.C. 154(b) by 148 days.

(21) Appl. No.: 13/585,597

(22) Filed: Aug. 14, 2012

(65) Prior Publication Data

US 2014/0051558 A1 Feb. 20, 2014

(51) Int. Cl.
*A63B 71/00* (2006.01)
*A63B 21/02* (2006.01)

(52) U.S. Cl.
USPC ..... 482/139; 482/121; 482/122; 482/126

(58) Field of Classification Search
USPC ..... 482/139, 92, 91, 148, 81, 82, 121–126
See application file for complete search history.

(56) References Cited

U.S. PATENT DOCUMENTS

| | | | | |
|---|---|---|---|---|
| 113,384 | A | 4/1871 | Barnett | |
| 232,579 | A | 9/1880 | Weeks | |
| 652,617 | A | 6/1900 | Hotz | |
| 2,930,614 | A * | 3/1960 | McIntosh | 482/126 |
| 3,427,023 | A | 2/1969 | Silberman | |
| 5,431,617 | A | 7/1995 | Rattray, Jr. | |
| 5,505,677 | A | 4/1996 | Hinds | |
| 5,549,532 | A | 8/1996 | Kropp | |
| 5,800,322 | A | 9/1998 | Block | |
| 6,497,641 | B1 | 12/2002 | Hinds | |
| 6,676,576 | B1 | 1/2004 | Wu | |
| 6,923,750 | B1 | 8/2005 | Hinds | |
| 7,147,592 | B2 | 12/2006 | Hinds | |
| 7,316,636 | B1 | 1/2008 | Hinds | |
| 7,326,157 | B2 * | 2/2008 | Wu | 482/126 |
| 7,344,485 | B1 | 3/2008 | Simpson | |
| 7,357,762 | B1 | 4/2008 | Terry | |
| 7,377,886 | B2 | 5/2008 | Wu | |
| 7,448,990 | B2 | 11/2008 | Wu | |
| 7,455,632 | B2 * | 11/2008 | Block et al. | 482/126 |
| 7,503,883 | B2 | 3/2009 | Madden | |
| 7,578,775 | B2 | 8/2009 | Terry | |
| 7,628,743 | B1 | 12/2009 | Flentye et al. | |
| D650,873 | S | 12/2011 | Terry | |
| 8,075,461 | B2 | 12/2011 | Terry | |
| 8,075,462 | B1 | 12/2011 | Hinds | |
| 8,152,703 | B1 | 4/2012 | Hinds | |
| 8,348,814 | B1 | 1/2013 | Hinds et al. | |
| 8,480,549 | B1 * | 7/2013 | Hinds et al. | 482/143 |
| 8,491,446 | B2 | 7/2013 | Hinds et al. | |

(Continued)

*Primary Examiner* — Loan H Thanh
*Assistant Examiner* — Megan Anderson
(74) *Attorney, Agent, or Firm* — Barnes & Thornburg LLP

(57) ABSTRACT

A handle for engaging a stretchable tube for use in exercise comprising a yoke and a handgrip. The yoke defining first and second passages and a channel. The first passage sized to permit the passage therethrough of the elongate member and a portion associated with the elongate member and the second passage and channel sized to permit the passage therethrough of the elongate member and to prevent the passage therethrough of the enlarged portion. The channel interconnecting the first and second passages for moving the elongate member from the first passage to the second passage for engagement within the second passage. An exercise device comprising one or more of the handles, the elongate member and one or more enlarged portions. A method of constructing the exercise device by securing the handle to the elongate member.

21 Claims, 10 Drawing Sheets

(56) References Cited

U.S. PATENT DOCUMENTS

| | | | | |
|---|---|---|---|---|
| 8,657,727 | B1 | 2/2014 | Kassel et al. | |
| 2005/0075223 | A1* | 4/2005 | Wu | 482/126 |
| 2005/0137066 | A1 | 6/2005 | Wu | |
| 2006/0105893 | A1* | 5/2006 | Chen | 482/126 |
| 2007/0155600 | A1 | 7/2007 | Cunningham et al. | |
| 2008/0300117 | A1* | 12/2008 | Madden | 482/126 |
| 2011/0237410 | A1 | 9/2011 | Perez | |
| 2012/0302406 | A1 | 11/2012 | Hinds et al. | |
| 2013/0288864 | A1* | 10/2013 | Holland | 482/126 |

* cited by examiner

EXERCISE DEVICE AND HANDLE FOR SAME

The present disclosure relates generally to an exercise device and to a handle for an exercise device.

BACKGROUND

Resistance exercise devices comprising a stretchable elongate tube and a pair of handles are known. An example of a resistance exercise device including a stretchable elongate tube is disclosed, for example, in U.S. Pat. No. 5,800,322, which is incorporated herein by reference. Such exercise devices typically are available in tubes of different resistances. The resistance level is based upon the resistance level of the tube.

SUMMARY

The present disclosure is directed to a handle for engaging a stretchable tube or other elongate member for use in exercise. The handle comprises a yoke and a handgrip. The yoke includes a base defining first and second passages extending through the base. The first passage is sized to permit the passage therethrough of the elongate member and an enlarged end or other enlarged portion associated with the elongate member. The second passage is sized to permit the passage therethrough of the elongate member and to prevent the passage therethrough of the enlarged portion. The base also defines a channel extending through the base interconnecting the first and second passages. The channel is sized to prevent passage therethrough of the enlarged portion. The first passage is configured to receive the elongate member and the enlarged portion. The channel is configured to permit movement of the elongate member from the first passage to the second passage to secure the elongate member to the base. The base may comprise a pair of opposed side surfaces such that none of the first passage, the second passage, and the channel extends to either of the opposed side surfaces. The yoke may have a U-shaped configuration.

The base may include first and second sections defining the second passage. The first section defines a first bore and the second section defines a second bore. The first and second bores are contiguous with each other and with the second passage, the first section for engaging the enlarged portion. The first section may include a ledge configured to engage the enlarged portion.

The present disclosure is also directed to an exercise device comprising the handle, the elongate member and the enlarged portion associated with the elongate member. The exercise device may include a pair of handles and a pair of enlarged portions and each handle may be secured to a respective end of the elongate member. The present disclosure is also directed to a method of constructing the exercise device by securing the handle to the elongate member.

Features and advantages of the disclosure will be set forth in part in the description which follows and the accompanying drawings described below, wherein embodiments of the disclosure is described and shown, and in part will become apparent upon examination of the following detailed description taken in conjunction with the accompanying drawings.

BRIEF DESCRIPTION OF THE DRAWINGS

Other aspects and advantages of the present disclosure will become apparent upon consideration of the following detailed description, wherein similar structures have like or similar reference numerals.

DETAILED DESCRIPTION

Figure 1:
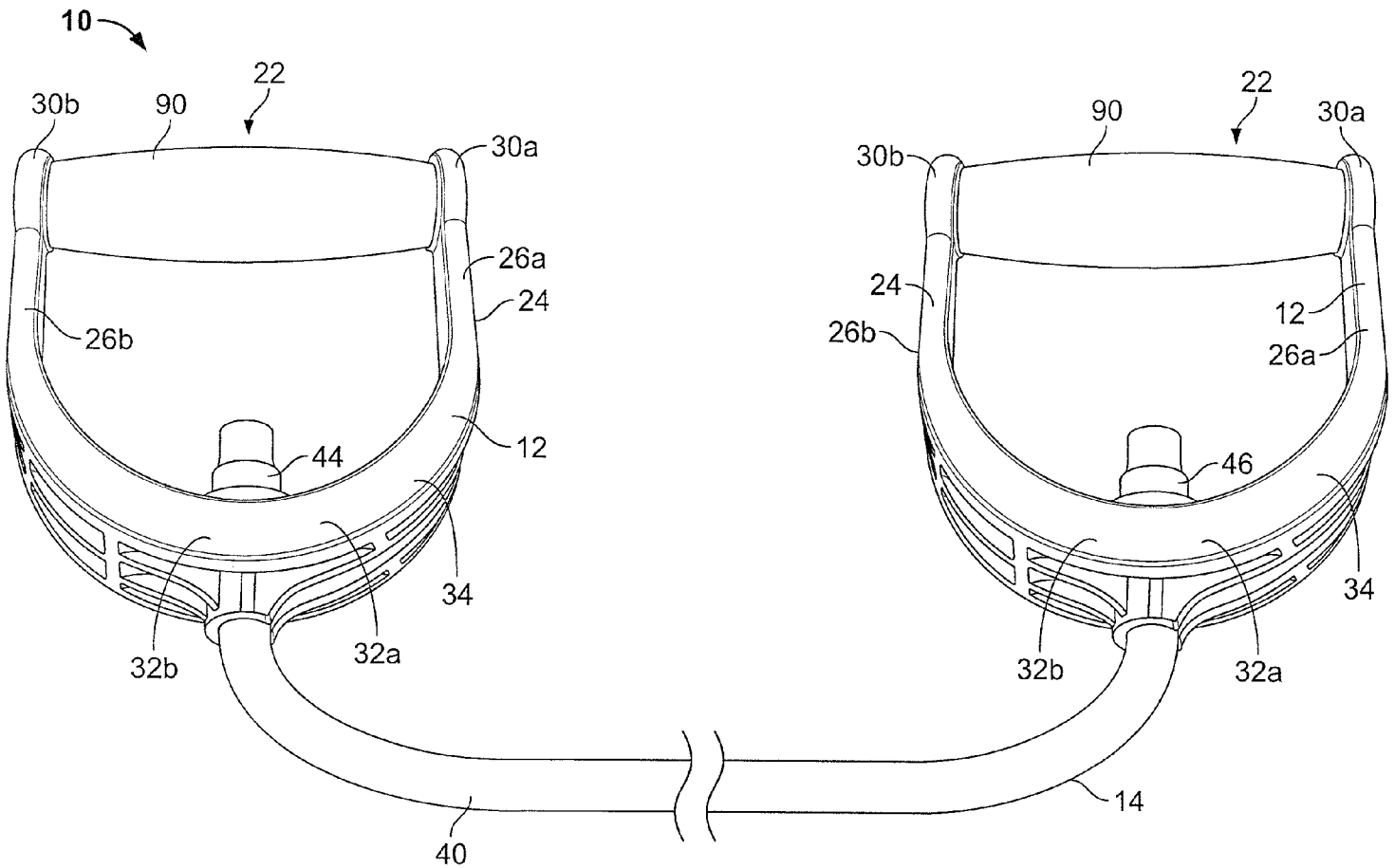
FIG. 1 is a front elevational view of an exercise device in accordance with an illustrated embodiment of the present disclosure having two handles, an elongate member and a pair of enlarged portions associated with the ends of the elongate member.
Figure 2:
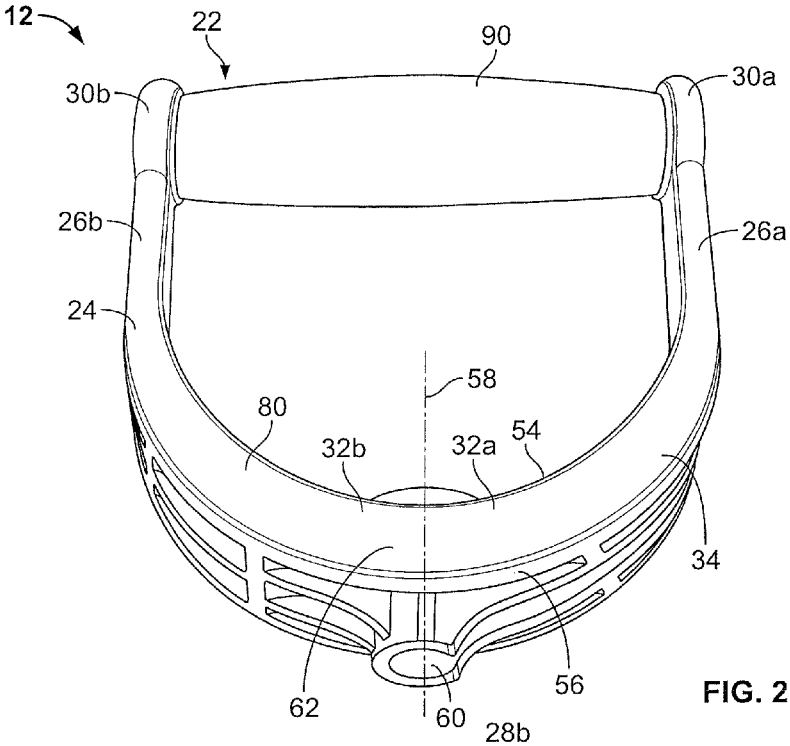
FIG. 2 is a bottom perspective view of the handle of the exercise device of FIG. 1.

The present disclosure is directed to an exercise device and a handle for the exercise device. While the present disclosure may be embodied in many different forms, several specific embodiments are discussed herein with the understanding that the present disclosure is to be considered only as an exemplification of the principles of the disclosure, and it is not intended to limit the disclosure to the embodiments illustrated.

FIGS. 1-9 depict a first embodiment of an exercise device 10 comprising a handle 12 and an elongate member 14. The handle 12 generally includes a handgrip 22 and a yoke 24 extending outwardly from the handgrip 22 and generally having a U-shape. The yoke 24 includes first and second arms 26*a*, 26*b* having apertures 28*a*, 28*b* through first ends 30*a*, 30*b* of the arms 26*a*, 26*b*, respectively. The apertures 28*a*, 28*b* are in communication with the handgrip 22, as described hereinafter. Second ends 32*a*, 32*b* of the arms 26*a*, 26*b* curve inwardly and are integrally connected to form the yoke 24. The yoke 24 includes a base 34 interconnecting the arms 26*a*,

26*b*. While the yoke 24 is shown and described as being U-shaped, the yoke 24 may take other shapes in accordance with other embodiments of the present disclosure.

The elongate member 14 may be in the form of a stretchable or otherwise elastic tube 40 having a pair of ends, each end secured to one of the handles 12. The illustrated elastic tube 40 has a dimension in the form of diameter D1 and first and second enlarged ends 44, 46 having a dimension in the form of diameter D2. The diameter D1 is less than the diameter D2. While the elastic tube 40 and enlarged ends 44, 46 are shown as having a generally circular cross-section and having diameters, the elastic tube 40 and/or enlarged ends 44, 46 may have different cross-sections, for example, a square-shaped, hexagonal, pentagonal, or other cross-sectional. The elongate member 14 may be constructed of any other resilient material or other material and have any other suitable dimensions and configuration in accordance with other embodiments of the present disclosure. In the illustrated embodiment, the enlarged ends 44, 46 are formed by insertion of plugs within the channel defined by the elongate member. The enlarged ends 44, 46 may be associated with the elastic tube 40 as disclosed above or in any other suitable manner. The enlarged ends may be formed by any other suitable means and also may instead be in the form of enlarged portions formed in any suitable manner anywhere along the length of the elongate member 14.

Figure 3:
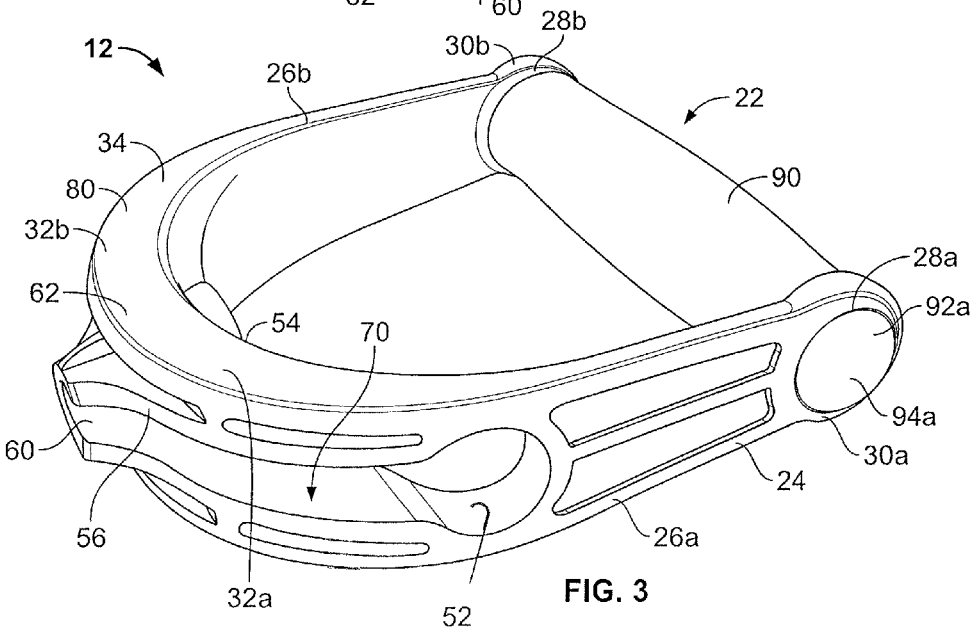
FIG. 3 is a side perspective view of the handle of FIG. 2.
Figure 4:
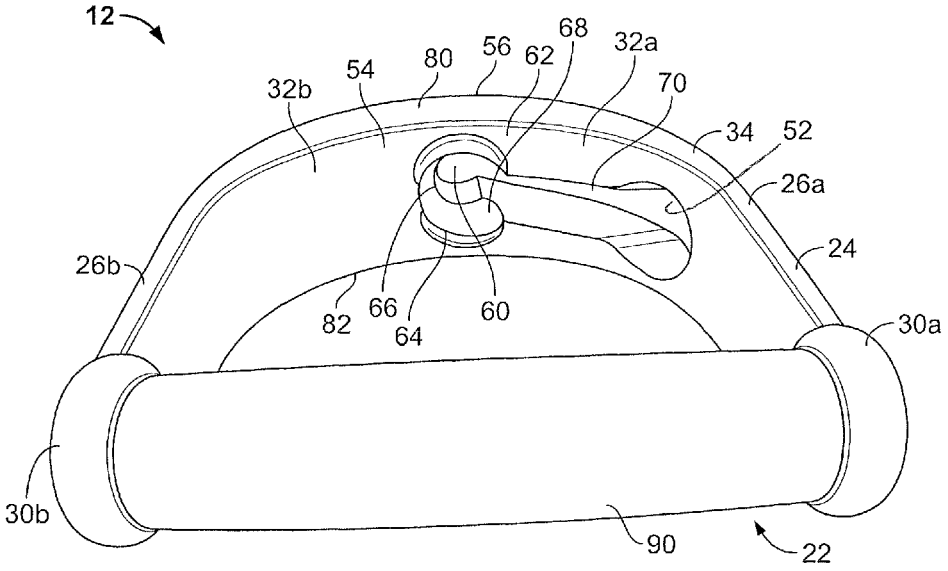
FIG. 4 is a top perspective view of the handle of FIG. 1.
Figure 5:
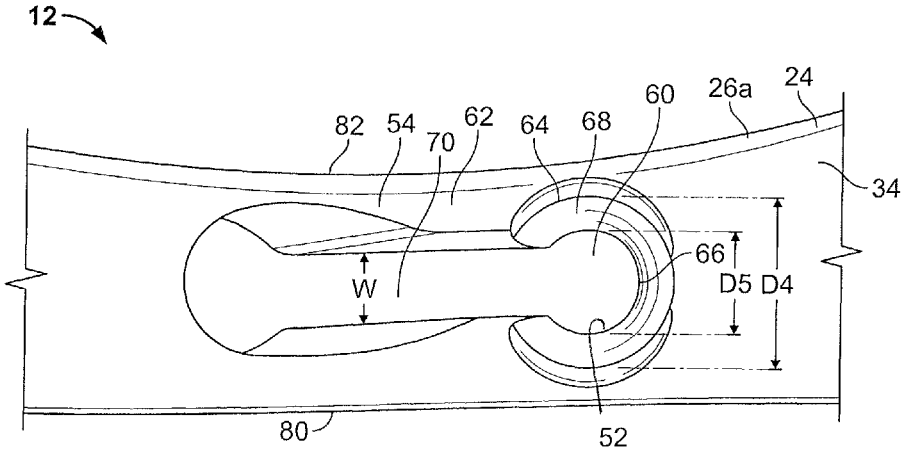
FIG. 5 is a partial top elevational view of the handle of FIG. 2.

With reference to FIGS. 3-5, the base 34 of the yoke 24 includes a first passage 52 disposed within the first arm 26*a* and extending between first and second opposing surfaces 54, 56 of the yoke 24. The first passage 52 extends through the base 34. The first passage 52 has a clearance dimension in the form of diameter D3. The diameter D3 is greater than the diameter D1 of the elastic tube 40 and the diameter D2 of the enlarged ends 44, 46. A second passage 60 is disposed through a center 62 of the yoke 24 between the first and second arms 26*a*, 26*b*. The second passage 60 also extends between the first and second opposing surfaces 54, 56 of the base 34, and extends through the base 34.

Referring to FIGS. 3 and 4, the second passage 60 includes an upper section 64 having a dimension in the form of diameter D4 and a lower section 66 having a clearance dimension in the form of diameter D5. The diameter D5 is less than the diameter D4, thereby creating a ledge 68 between the upper and lower sections 64, 66. The diameter D4 is greater than the diameter D2 of the enlarged ends 44, 46 of the elongate member 14 and the diameter D5 is less than the diameter D2 of the enlarged ends 44, 46 of the elongate member 14. The second passage 60 has a longitudinal axis 58 that generally bisects the handle 12. In this manner, when the elongate member 14 is attached to the yoke 24 and a user grips and pulls upwardly on the handgrip 22, the elongate member 14 is generally coincident with the longitudinal axis 58 of the second passage 60, as will be discussed in greater detail hereinafter.

Figure 6:
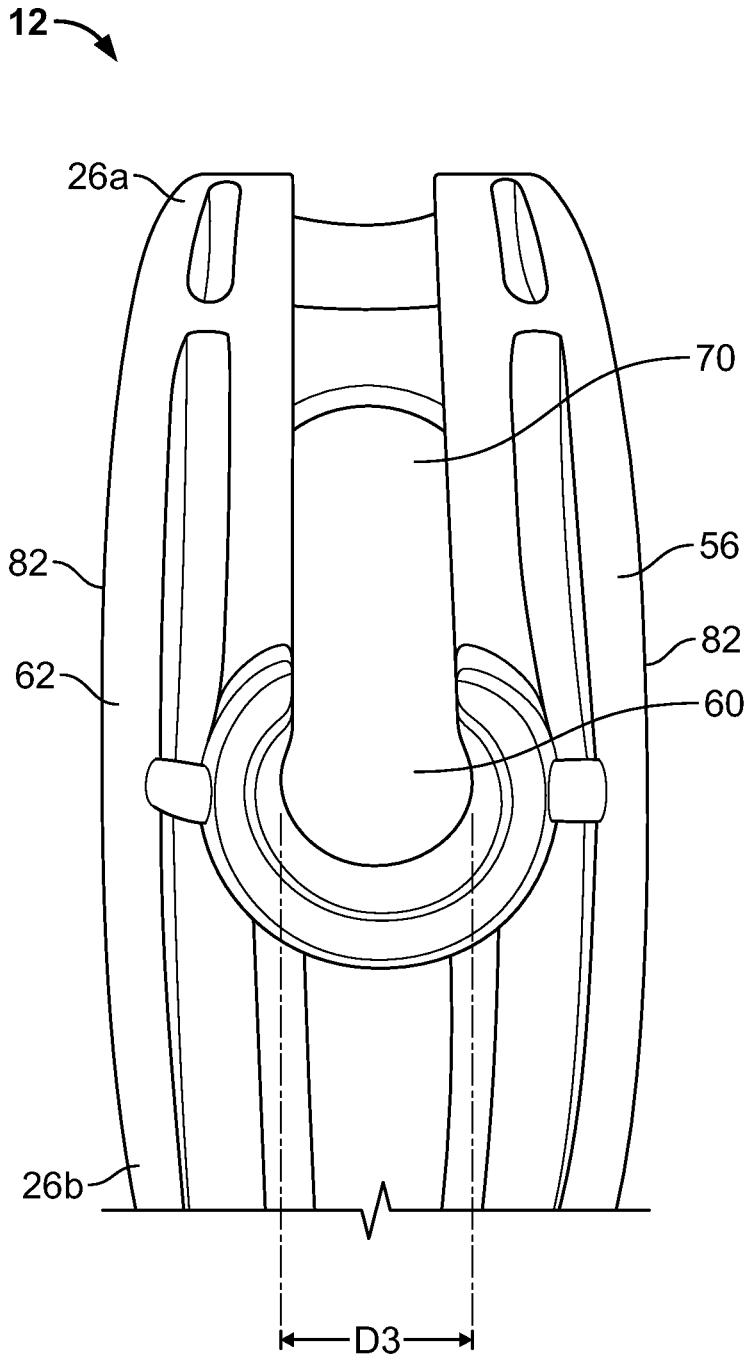
FIG. 6 is a bottom elevational view of the handle of FIG. 2.

With reference to FIGS. 4-6, a channel 70 extends between the first and second opposing surfaces 54, 56 of the yoke 24 and interconnects the first and second passages 52, 60. The channel 70 extends through the base 34. Each of the first and second passages 52 and 60 is illustrated as being generally cylindrical and as being in communication with the channel 70. The channel 70 has a clearance dimension in the form of a width W that is greater than the diameter D1 of the elastic tube, but less than the diameter D2 of the enlarged ends 44, 46 of the elongate member 14. While the first and second passages 52, 60 are disclosed and shown as being cylindrical, the passages 52, 60 may optionally be of a different cross-sectional shape, for example, square-shaped, hexagonal, pentagonal, or any other cross-sectional shape. In such an embodiment, the passages 52, 60 may have different forms of clearance dimensions.

The first passage 52, the second passage 60, and the channel 70 interconnecting the first and second passages 52, 60 extend through the yoke 24 between the first and second opposing surfaces 54, 56, but do not extend to front and rear opposing surfaces 80, 82 of the yoke 24.

The first passage 52 is sized to permit the passage therethrough of the elongate member 14 and one of the enlarged portions 44, 46. The second passage 60 is sized to permit the passage therethrough of the elastic tube 40 and to prevent the passage therethrough of the enlarged portion. The channel 70 is sized to permit passage therethrough of the elongate member 14 and to prevent passage through the channel of the enlarged end so that the elongate member can be moved from the first passage 52 to the second passage 60.

Figure 7A:
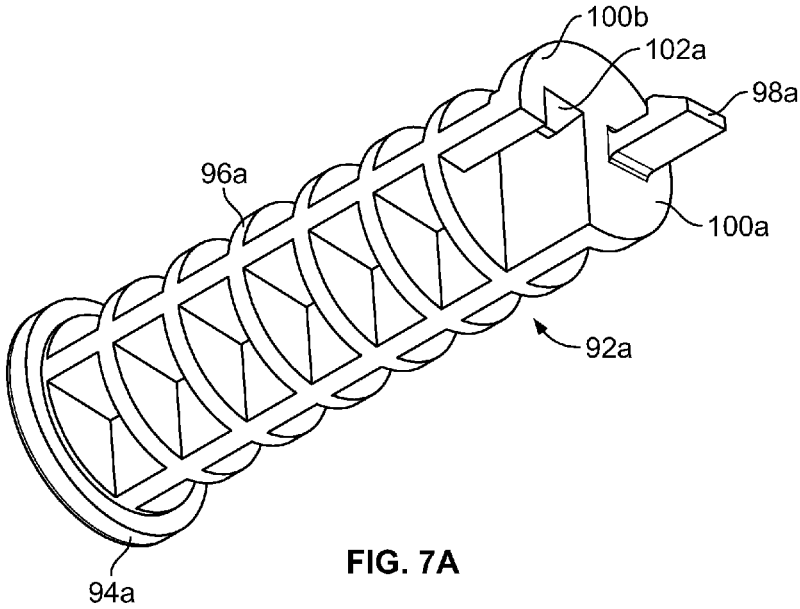
FIG. 7A is a perspective view of a first core member of a handgrip of the handle of FIG. 2.
Figure 7B:
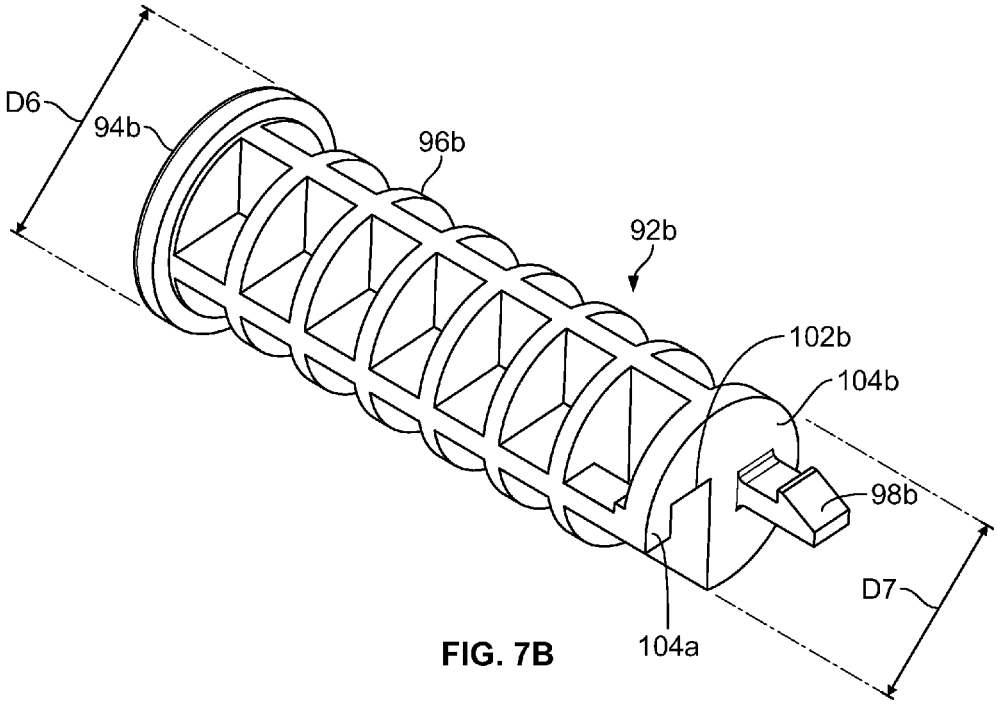
FIG. 7B is a perspective view of a second core member of the handgrip of the handle of FIG. 2.
Figure 7C:
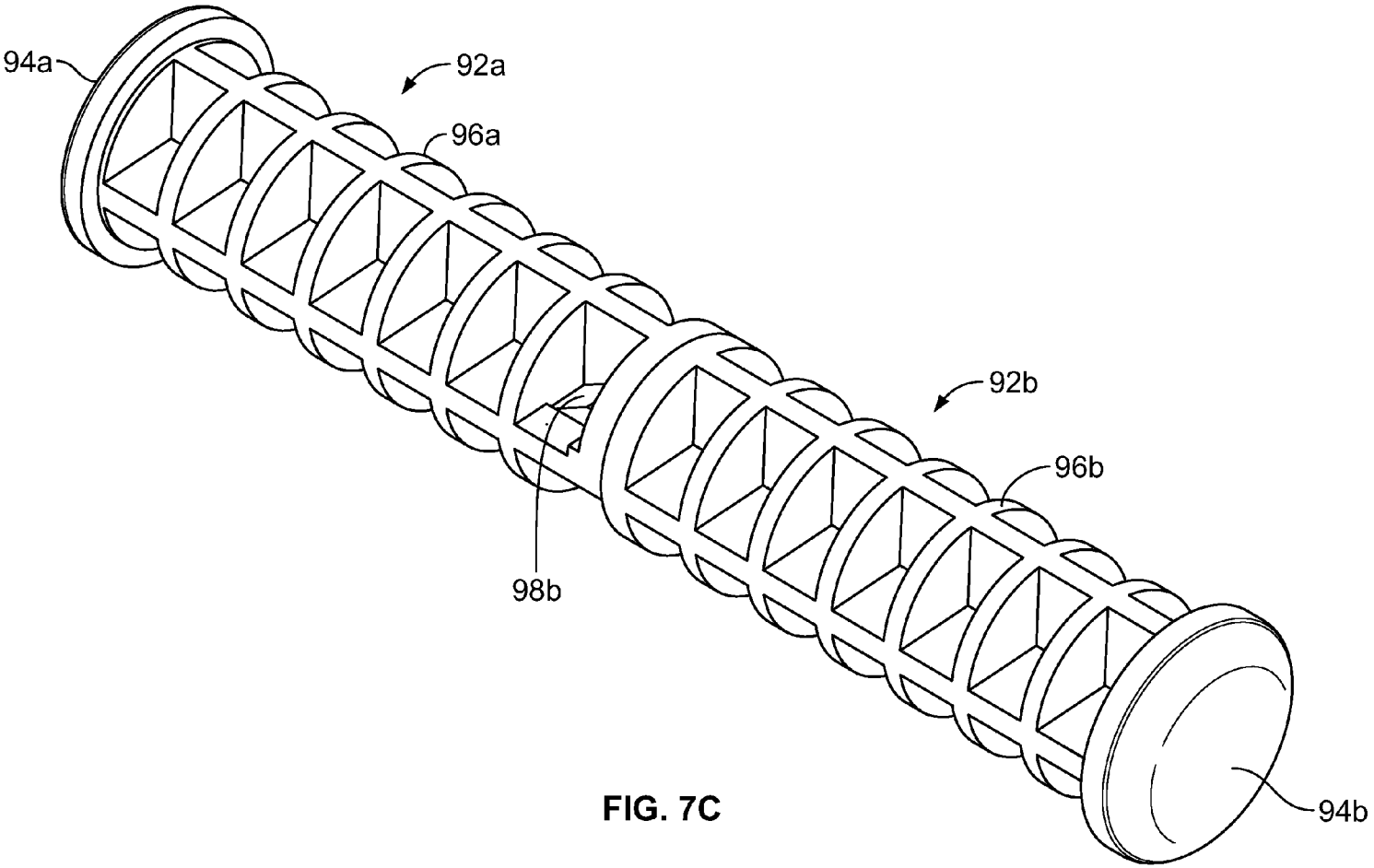
FIG. 7C is a perspective view of the first and second core members seen in FIGS. 7A and 7B, wherein the core members are attached to one another.
Figure 8:
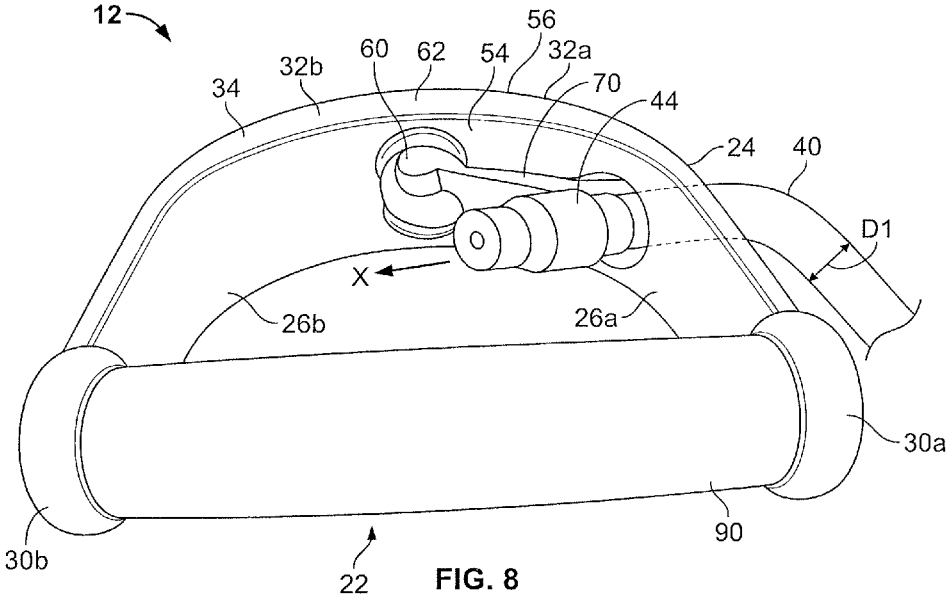
FIG. 8 is a top perspective view of the handle of FIG. 2 illustrating one of the enlarged portions within a first passage of the handle.
Figure 9:
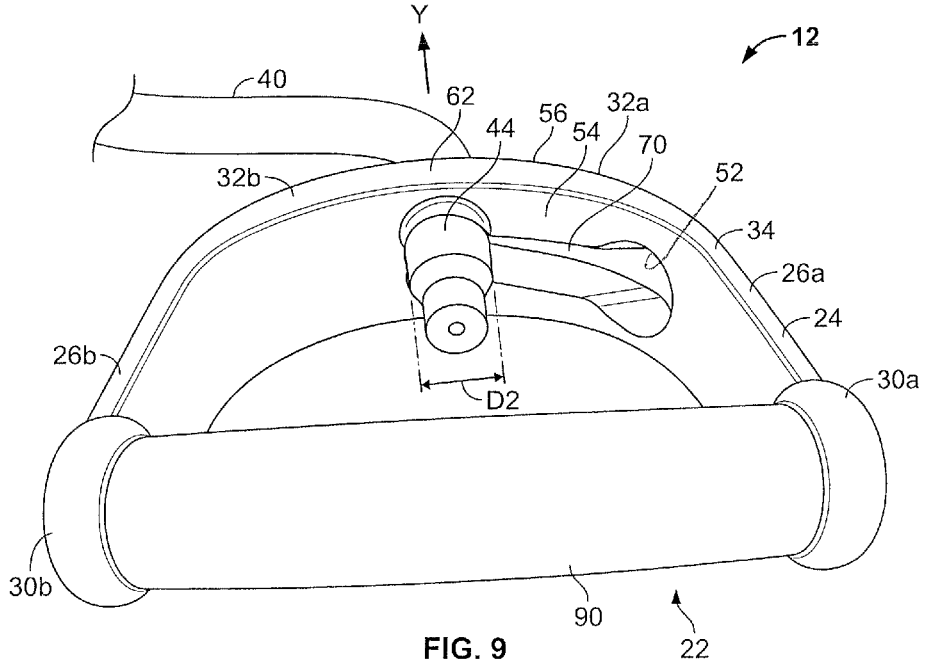
FIG. 9 is a top perspective view of the handle and enlarged portion of FIG. 8 illustrating the enlarged portion disposed within the second passage after the elongate member has been moved along the channel into the second passage.

Referring to FIGS. 4 and 7A-7C, the handgrip 22 includes a hollow cylindrical tube 90 and first and second core members 92*a*, 92*b* extending through the apertures 28*a*, 28*b* in the arms 26*a*, 26*b* and connected within the cylindrical tube 90 to form the handgrip 22. The first and second core members 92*a*, 92*b* include first and second end caps 94*a*, 94*b* having a dimension in the form of diameter D6 and first and second supports 96*a*, 96*b* extending outwardly from the first and second end caps 94*a*, 94*b*, respectively, and having a generally cylindrical profile and having a dimension in the form of diameter D7 less than the diameter D6 of the end caps 94*a*, 94*b*. As seen in FIG. 7A, the first core member 92*a* further includes an upwardly extending hook member 98*a* extending outwardly from a first side 100*a* of the first support 96*a* and a downwardly facing groove 102*a* on a second side 100*b* of the support 96*a*. As seen in FIG. 7B, the second core member 92*b* includes a downwardly facing groove 102*b* on a first side 104*a* of the second support 96*b* and an upwardly extending hook member 98*b* extending outwardly from a second side 104*b* of the second support 96*b*.

The handgrip 22 is assembled by inserting the core members 92*a*, 92*b* through the apertures 28*a*, 28*b* in the arms 26*a*, 26*b*, respectively. The core members 92*a*, 92*b* are aligned such that the upwardly extending hook member 98*a* of the first support 96*a* is aligned with the downwardly facing groove 102*b* of the second support 96*b* and the upwardly extending hook member 98*b* of the second support 96*b* is aligned with the downwardly facing groove 102*a* of the first support 96*a*. The hook members 98*a*, 98*b* ride up ramps associated with the opposing grooves 102*a*, 102*b* and into the grooves 102*a*, 102*b* to connect and retain the core members 92*a*, 92*b*. Once assembled, it is difficult to pull the core members 92*a*, 92*b* apart. In addition, the diameter D6 of the end caps 94*a*, 94*b* is greater than a diameter of the apertures 28*a*, 28*b*, such that the end caps 94*a*, 94*b* abut respective arms 26*a*, 26*b* surrounding the apertures 28*a*, 28*b*.

In operation, each handle 12 is engaged with the elongate member 14 by inserting a respective one of the enlarged ends 44, 46 of the elastic tube 40 into the first passage 52 in a first direction X until the enlarged end 44 passes fully through the first passage 52 and the elongate member 14 is within the first passage. The user then slides the elastic tube 40 along the channel 70 until the elastic tube 40 is disposed in the second passage 60. Once in the second passage 60, the elastic tube 40 is pulled in a second direction Y that is coincident with the longitudinal axis 58 of the second passage 60. Due to the diameter D2 of the enlarged end 44 (or 46) being less than the diameter D4 of the upper section 64 of the second passage 60 and being greater than the diameter D5 of the lower cylindrical section 66 of the second passage 60, the enlarged end 44 is pulled into the upper section 64. The enlarged end 44 of the elastic tube 40 is seated on the ledge 68, thereby retaining the enlarged end 44 within the second passage 60. This process may be repeated to attach the second handle 12 to the other enlarged end 46 (or 44), as depicted in FIG. 1.

In the illustrated embodiment, dimension W of channel 70 is greater than the diameter D1 of the elastic tube 40. In accordance with other embodiments, the dimension W may be less than the diameter D1 of the elastic tube 40 in which event the elastic tube 40 may be pulled or otherwise stretched to fit within the channel 70 as it is moved to the second passage 60.

Once the handle 12 is secured to the elastic tube 40, the exercise device 10 may be used in any suitable manner. For example, the handle 12 may be used by gripping the handgrips 22 with one's hands or feet and performing exercises. A user may manually grasp one or both handles and perform exercise or may use their feet to engage one or more handles or step on a portion of the elastic tube 40 and move the handles 12 to perform exercises. Other exercises may include attaching the elastic tube 40 or one or both handles 14 to a structure and performing exercises.

Figure 10:
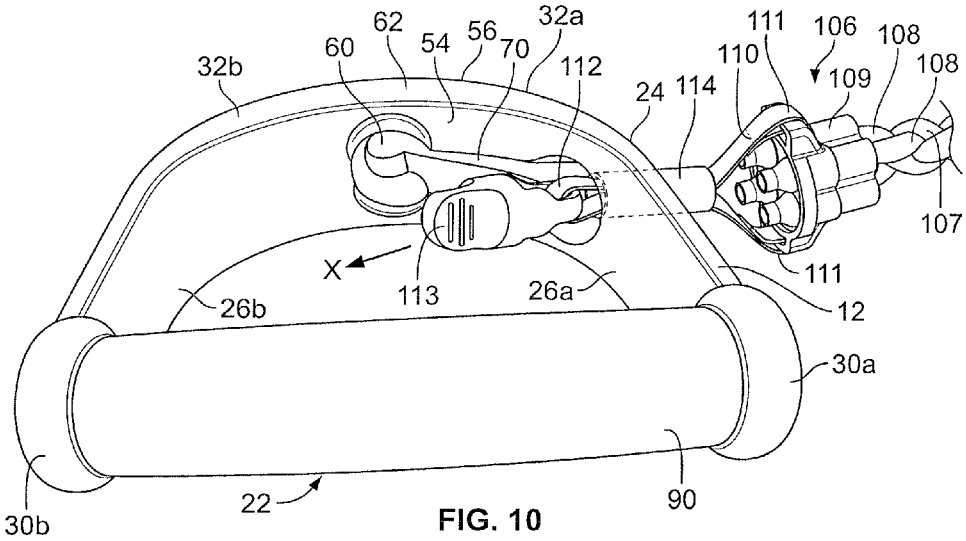
FIG. 10 is a top perspective view of the handle of an exercise device in accordance with an other embodiment illustrating the enlarged portion associated with the elongate member of the exercise device disposed within the first passage of the handle and the elongate member comprising a braided cord and enlarged portion being in the form of a plug.
Figure 11:
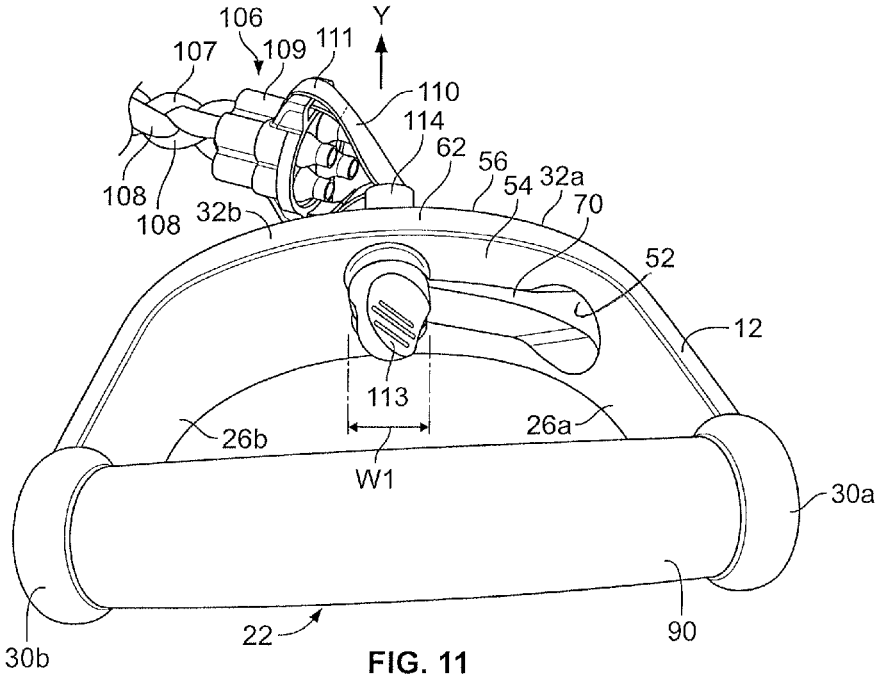
FIG. 11 is a top perspective view of the handle of FIG. 10 with the enlarged portion disposed within the second passage and after the elongate member of the exercise device has been moved along the channel into the second passage.
Figure 12:
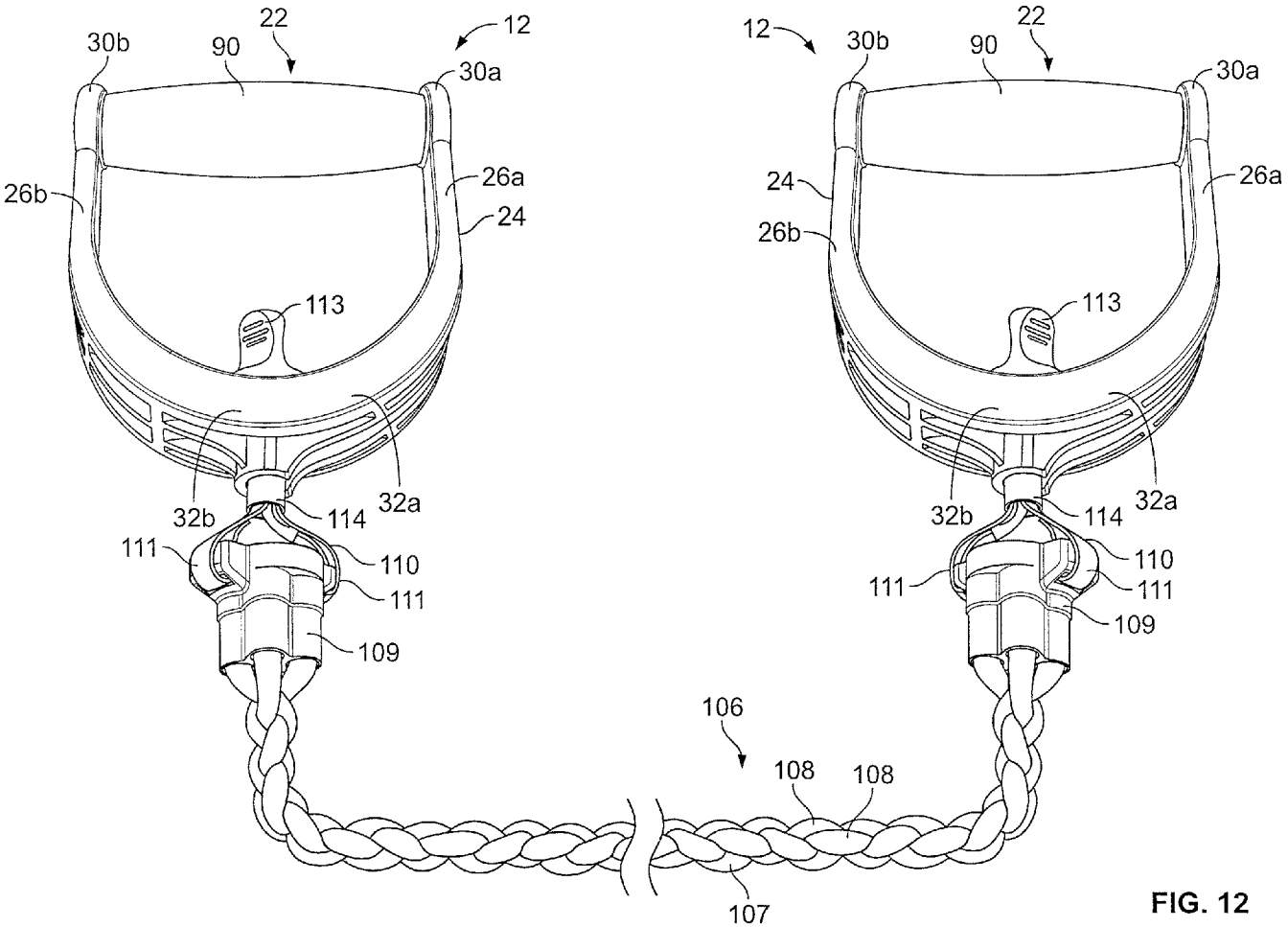
FIG. 12 is a front elevational view of two handles of FIG. 10 engaged with the elongate member of FIG. 10.

As seen in FIGS. 10-12, the handle 12 may be used with a further elongate member 106 in the form of a cord 107 formed of multiple elastic tubes 108 that are braided. The tubes 108 are connected by a retention mechanism 109 and inelastic webbing 110 is connected at ends 111 thereof to opposite sides of the retention mechanism 109. A central section 112 of the webbing 110 is connected to an enlarged end of the elongate member 106 in the form of a plug 113, and a tubular member 114 is disposed over the webbing 110 between the retention mechanism 109 and the plug 113. The plug 113 or other enlarged portion may be associated with the elongate member 106 as disclosed above or in any other suitable manner. In the embodiment of FIGS. 10-12, the elongate member 106 includes the cord 107 and the structures connecting the cord 107 to the plug 113, including the retention mechanism 109, the webbing 110 and the tubular member 114.

In operation, the handle 12 is used by inserting the plug 113 into the first passage 52 in the first direction X until the plug 113 passes fully through the first passage 52. The user then slides the tubular member 114 through the channel 70 until the tubular member 114 is disposed in the second passage 60. Once in the second passage 60, the tubular member 114 is pulled in the second direction Y that is coincident with the longitudinal axis 58 of the second passage 60. A width W1 of the plug 113 is less than the diameter D4 of the upper section 64 of the second passage 60 and is greater than the diameter D5 of the lower cylindrical section 66 of the second passage 60. The plug 113 is therefore pulled into the upper section 64 until the plug 113 is seated and retained against the ledge 68. Thus, in the embodiment of FIGS. 10-12, the enlarged portions or ends of the elongate member 106 comprises the plug 113. This process may be repeated to attach a second handle 12 to an opposite end of the elongate member 106, as depicted in FIG. 12.

Once assembled with the elongate member 106, the handles 12 may be used by gripping the handgrips 22 with one's hands or feet and performing exercises in the same manner as described above.

Figure 13:
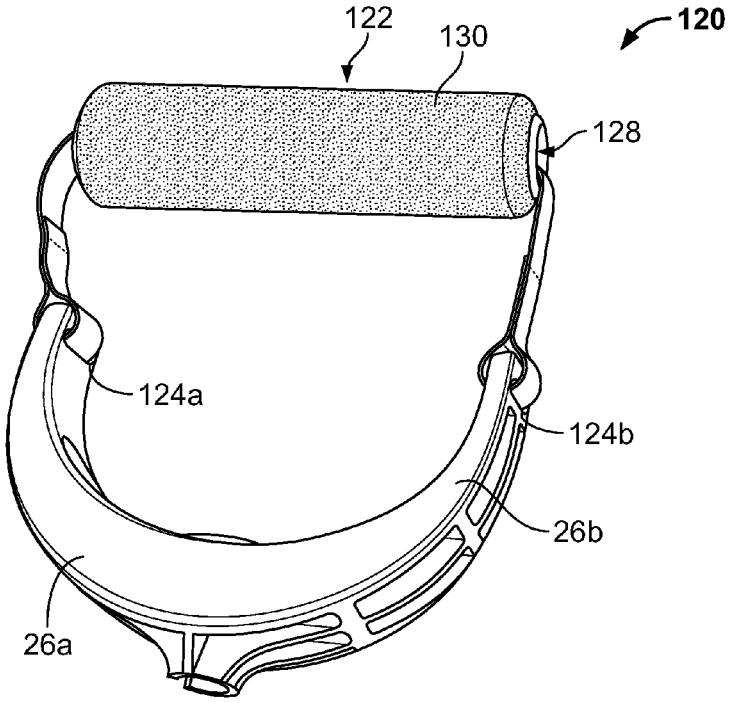
FIG. 13 is a bottom perspective view of a second embodiment of a handle depicting a handgrip including a strap attached to a yoke, wherein the strap extends through a padded grip to form the handgrip.
Figure 14:
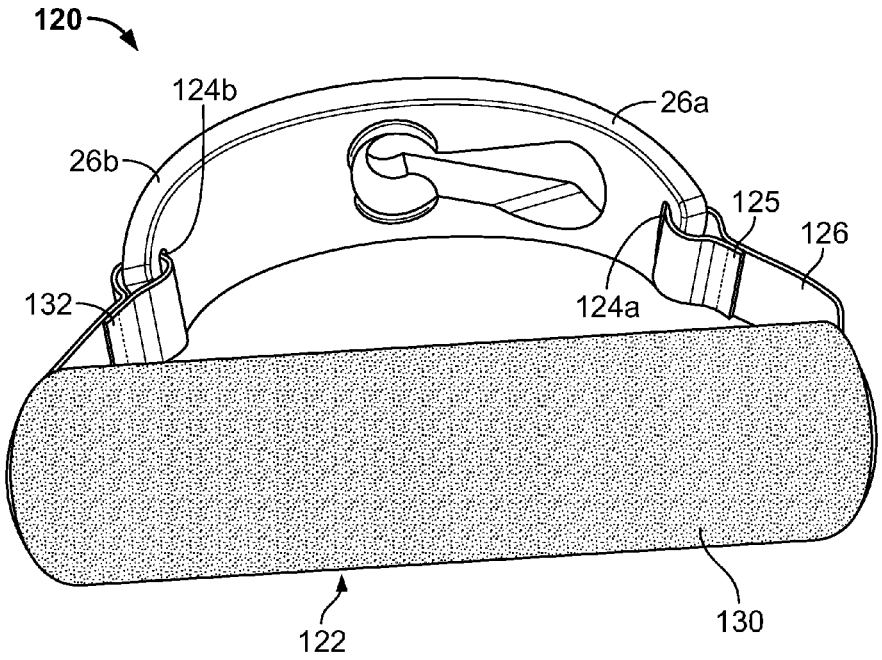
FIG. 14 is a top perspective view of the handle of FIG. 13.

A second embodiment of a handle 120 is depicted in FIGS. 13 and 14. The second handle 120 is similar to the handle 12 of the first embodiment, except that the handgrip 122 of the second embodiment differs from the handgrip 22 of the first embodiment. Features of the handle 120 similar to those of the handle 12 of the first embodiment will therefore be numbered similarly. The arms 26*a*, 26*b* of the yoke of the handle 12 are shorter and include elongated apertures 124*a*, 124*b*, respectively. A first end 125 of a strap 126 extends through the aperture 124*a* and is sewn to itself to connect the strap to the arm 26*a*. The strap 126 extends through a hollow core 128 of a padded grip 130 to form a handgrip and a second end 132 of the strap 126 extends through the aperture 124*b* and is sewn to itself to connect the strap to the arm 26*b*. The elongate member 14 or the elongate member 106 may be attached to the handle 120 in the same manner as disclosed with respect to the first embodiment and exercises are performed in the same manner.

The dimensions in the form of each of diameters D1-D7 and W may have any other suitable configuration and shape and thus may or may not be in the form of diameters. Further, the clearance dimensions described herein are intended to be the dimension in the passage of channel that limits the size of the structure that can pass therethrough regardless of the configuration of the clearance dimensions or the structure. For example, the clearance dimension of the first passage 52 may be sufficiently large to receive the enlarged end 44, 46 or 113, the clearance dimension of the second passage 60 may be sufficiently small to permit the enlarged end from passing therethrough, and the clearance dimension of channel 70 may be sufficiently small to permit the enlarged end from passing therethrough. Further, each of these clearance dimensions may be defined by any suitable structure of the base 34 that limits the size of the structure that can pass therethrough. For example, each clearance dimension may be defined by continuous structure of the base, by converging structure of the base, by ribs or similar structure, or by any other structure that defines the clearance dimension.

The present disclosure also includes a method of constructing the exercise device 10 by securing the handle 12 to the elongate member 14. The method may include the disclosure described above and may, for example, include the steps of: inserting the enlarged portion 44 (or 46 or 113) associated with the elongate member into the first passage 52 defined by the base 34 of the handle extending through the base, the first passage sized to permit the passage therethrough of the enlarged portion and the elongate member; moving the elongate member along the channel 70 defined by the base of the handle extending through the base from the first passage to the second passage defined by the base of the handle extending through the base, the channel interconnecting the first passage and the second passage, the channel sized to permit passage of the elongate member through the channel and to prevent passage of the enlarged portion through the channel, the second passage sized to permit the passage therethrough of the elongate member and to prevent the passage therethrough of the enlarged portion; and pulling the elongate member such that the enlarged portion is received by the second passage and engaged with a ledge of the base defining the second passage.

Any of the embodiments described herein may be modified to include any of the structures or methodologies disclosed in connection with other embodiments.

Numerous modifications to the present disclosure will be apparent to those skilled in the art in view of the foregoing description. Accordingly, this description is to be construed as illustrative only and is presented for the purpose of enabling those skilled in the art to make and use the embodiments of the disclosure and to teach the best mode of carrying out same. The exclusive rights to all modifications which come within the scope of the appended claims are reserved.

The invention claimed is:

1. A handle for engaging an elongate member for use in exercise, the handle comprising a yoke and a handgrip, the yoke including a base defining:

first and second passages extending through the base, the first passage sized to permit the passage therethrough of the elongate member and an enlarged portion associated with the elongate member and the second passage sized to permit the passage therethrough of the elongate member and to prevent the passage therethrough of the enlarged portion; and a channel extending through the base interconnecting the first and second passages, the channel sized to permit passage therethrough of the elongate member and to prevent passage therethrough of the enlarged portion;

wherein the first passage is configured to receive the elongate member and the enlarged portion, the channel is configured to permit movement of the elongate member from the first passage to the second passage to secure the elongate member to the base.

2. The handle of claim 1 wherein the base comprises a pair of opposed side surfaces and wherein none of the first passage, the second passage, and the channel extends to either of the opposed side surfaces.

3. The handle of claim 1 wherein the first passage includes a first clearance dimension, the second passage includes a second clearance dimension, and the channel includes a third clearance dimension, the first clearance dimension being greater than the second clearance dimension and the third clearance dimension.

4. The handle of claim 3 wherein at least one of the first clearance dimension and second clearance dimension is a diameter.

5. The handle of claim 1 wherein the base includes first and second sections defining the second passage, the first section having a first clearance dimension and the second section having a second clearance dimension greater than the clearance dimension of the first section, the first section for engaging the enlarged portion.

6. The handle of claim 5 wherein the first section includes a ledge configured to engage the enlarged portion.

7. The handle of claim 1 wherein the yoke further includes a pair of arms disposed about the base, the handgrip interconnecting the arms.

8. The handle of claim 1 wherein the yoke has a generally U-shaped configuration.

9. An exercise device comprising a handle, an elongate member and an enlarged portion associated with the elongate member, the handle comprising a yoke and a handgrip, the yoke including a base defining:

first and second passages extending through the base, the first passage sized to permit the passage therethrough of the elongate member and the enlarged portion and the second passage sized to permit the passage therethrough of the elongate member and to prevent the passage therethrough of the enlarged portion; and a channel extending through the base connecting the first and second passages, the channel sized to permit passage therethrough of the elongate member and to prevent passage therethrough of the enlarged portion;

wherein the first passage is configured to receive the elongate member and the enlarged portion and the channel is configured to permit movement of the elongate member from the first passage to the second passage to secure the elongate member to the base.

10. The exercise device of claim 9 wherein the base comprises a pair of opposed side surfaces and wherein none of the first passage, the second passage, and the channel extends to either of the opposed side surfaces.

11. The exercise device of claim 9 wherein the first passage includes a first clearance dimension, the second passage includes a second clearance dimension, and the channel includes a third clearance dimension, the first clearance dimension being greater than the second clearance dimension and the third clearance dimension.

12. The exercise device of claim 11 wherein at least one of the first clearance dimension and second clearance dimension is a diameter.

13. The exercise device of claim 9 wherein the base includes first and second sections defining the second passage, the first section having a first clearance dimension and the second section having a second clearance dimension greater than the clearance dimension of the first section, the first section for engaging the enlarged portion.

14. The exercise device of claim 13 wherein the first section includes a ledge configured to engage the enlarged portion.

15. The exercise device of claim 9 further including a pair of arms disposed about the base, the handgrip interconnecting the arms.

16. The exercise device of claim 9 wherein the elongate member has an end and the enlarged portion is associated with the end.

17. The exercise device of claim 9 wherein there are two handles and two enlarged portions.

18. The exercise device of claim 17 wherein the elongate member has two ends and each enlarged portion is associated with a respective end.

19. The exercise device of claim 9 wherein the elongate member comprises a stretchable tube.

20. A method of constructing an exercise device by securing a handle to an elongate member, the method including the steps of:

inserting an enlarged portion associated with the elongate member into a first passage defined by a base of the handle extending through the base, the first passage sized to permit the passage therethrough of the enlarged portion and the elongate member;

moving the elongate member along a channel defined by the base of the handle extending through the base from the first passage to a second passage defined by the base of the handle extending through the base, the channel interconnecting the first passage and the second passage, the channel sized to permit passage of the elongate member through the channel and to prevent passage of the enlarged portion through the channel, the second passage sized to permit the passage therethrough of the elongate member and to prevent the passage therethrough of the enlarged portion; and pulling the elongate member such that the enlarged portion is received by the second passage and engaged with a ledge of the base defining the second passage.

21. The method of claim 20 wherein the base includes first and second sections defining the second passage, the first section forming the ledge and wherein the pulling includes engaging the enlarged portion with the ledge.

* * * * *